US005839313A

United States Patent [19]

Ginzburg

[11] Patent Number: 5,839,313

[45] Date of Patent: Nov. 24, 1998

[54] ROLLING MILL WITH INTERMEDIATE CROSSED ROLLS BACKGROUND

[75] Inventor: Vladimir B. Ginzburg, Pittsburgh, Pa.

[73] Assignees: Danieli United, A Division of Danieli Corporation; International Rolling Mill Consultants, Inc., both of Pittsburgh, Pa.

[21] Appl. No.: 25,620

[22] Filed: Feb. 18, 1998

[51] Int. Cl.[6] ..... B21B 13/14; B21B 29/00; B21B 31/07

[52] U.S. Cl. ..... 72/241.2; 72/241.4

[58] Field of Search ..... 72/241.2, 241.4, 72/241.6, 241.8, 242.2, 242.4, 243.2, 243.4, 243.6, 244, 245, 247

[56] References Cited

U.S. PATENT DOCUMENTS

| | | | |
|---|---|---|---|
| 1,860,931 | 2/1932 | Keller . | |
| 2,762,295 | 10/1956 | Varga et al. . | |
| 3,724,252 | 4/1973 | Baker et al. . | |
| 4,369,646 | 1/1983 | Kajiware . | |
| 4,385,512 | 5/1983 | Matsumoto et al. . | |
| 4,440,957 | 4/1984 | Carlstedt et al. . | |
| 4,453,393 | 6/1984 | Hino et al. . | |
| 4,499,748 | 2/1985 | Nihei et al. . | |
| 4,539,833 | 9/1985 | Kato et al. . | |
| 4,691,548 | 9/1987 | Richter et al. | 72/241.8 |
| 4,712,416 | 12/1987 | Rommen et al. . | |
| 4,727,741 | 3/1988 | Ushifusa et al. . | |
| 5,119,656 | 6/1992 | Kobayashi et al. . | |
| 5,239,851 | 8/1993 | Takakura et al. . | |
| 5,291,770 | 3/1994 | Koujin et al. | 72/241.2 |
| 5,365,764 | 11/1994 | Kajiware et al. . | |
| 5,390,518 | 2/1995 | Morimoto et al. . | |
| 5,655,398 | 8/1997 | Ginzburg . | |

*Primary Examiner*—Joseph J. Hail, III
*Assistant Examiner*—Rodney Butler
*Attorney, Agent, or Firm*—Armstrong, Westerman, Hattori, McLeland & Naughton

[57] ABSTRACT

In a mill for cross rolling metal strip and having upper and lower work rolls and backup rolls, at least one crossed intermediate roll is disposed between at least one pair of work roll and backup roll.

8 Claims, 3 Drawing Sheets

ROLLING MILL WITH INTERMEDIATE CROSSED ROLLS BACKGROUND

BACKGROUND

1. Field of the Invention

This invention relates to rolling of metal sheet or strip (hereinafter "strip") in a rolling mill and, more particularly, to cross-rolling the strip by means of at least one intermediate roll disposed between a work roll and a backup roll and crossed at an angle to a longitudinal axis of the work roll.

2. Description of the Prior Art

As noted, for example, in U.S. Pat. No. 5,655,398, which is incorporated herein and made a part hereof by this reference, roll crossing, without or with roll shifting (as described in the above patent), is used to modify the profile of a roll gap between an upper and a lower work roll for control of the flatness and profile of a rolled workpiece. Presently, one of three roll crossing systems is used in rolling mills for rolling flat products.

First, work roll crossing is used, as shown in FIG. 1 hereof, and as exemplified by U.S. Pat. No. 4,385,512; U.S. Pat. No. 4,727,741; U.S. Pat. No. 5,365,764, and U.S. Pat. No. 5,390,518.

Second, backup roll crossing is used, as shown in FIG. 2 hereof, and as exemplified by U.S. Pat. No. 1,860,931 and U.S. Pat. No. 2,762,295incorporated herein and made a part hereof by this reference.

Third, pair-crossing is used in which both work rolls and backup rolls are crossed, as shown in FIG. 3 hereof, and as exemplified by U.S. Pat. No. 4,453,393.

Work roll crossing produces "strip walking," that is, a tendency of the strip to shift from the centerline of the mill, as shown in FIGS. 4A and 4B hereof whether using a concave or convex work roll design. Moreover, because of the shearing force acting in the width direction of the strip, work roll crossing produces a rhombic shape of the strip cross-section, as shown in FIG. 5 hereof. Backup roll crossing is much more expensive than work roll crossing, and a pair-cross mill combines the disadvantages of work roll crossing and backup roll crossing.

Rolling mills sometimes are provided with intermediate rolls between the work rolls and the backup rolls, exemplified by U.S. Pat. No. 3,724,252; U.S. Pat. Nos. 4,369,646, 4,400,957, 4,499,748, and 4,712,416 (each including axial adjustment of the intermediate roll, that is, along the longitudinal axis of the work roll); U.S. Pat. No. 4,539,833 (intermediate roll is offset in the downstream direction from the reduction line interconnecting the axis of the upper and lower backup rolls), and U.S. Pat. No. 5,239,851 (bendable intermediate roll).

SUMMARY OF THE INVENTION

This invention enhances the technical performance and economy of cross rolling of metal strip in a rolling mill by providing either a single crossed intermediate roll between a work roll and a backup roll (typically a 5 high mill) or double crossed intermediate rolls between each work roll and its corresponding backup roll (typically a 6 high mill).

DESCRIPTION OF PREFERRED EMBODIMENTS

Figure 1:
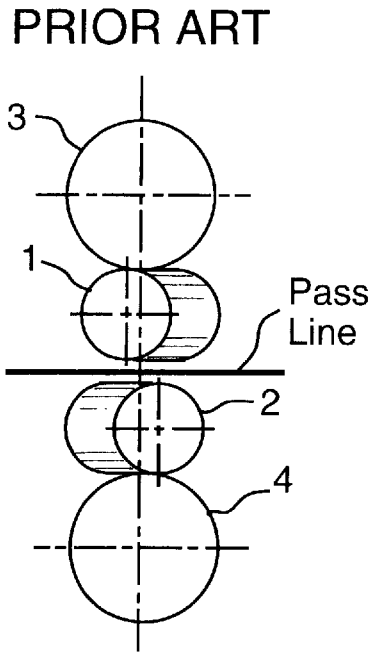
FIG. 1 is a schematic end elevation of prior art rolling mill rolls in which the work rolls are crossed.
Figure 2:
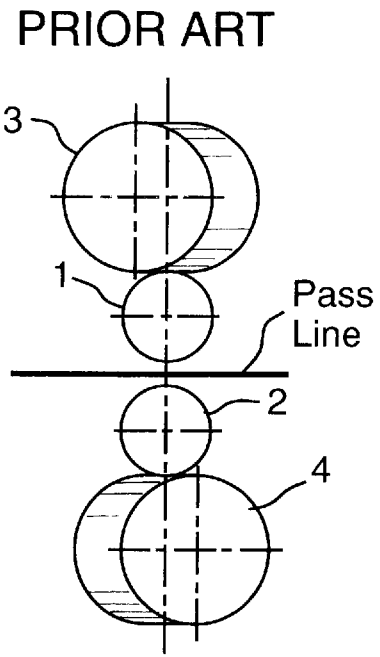
FIG. 2 is a schematic end elevation of prior art rolling mill rolls in which the backup rolls are crossed.
Figure 3:
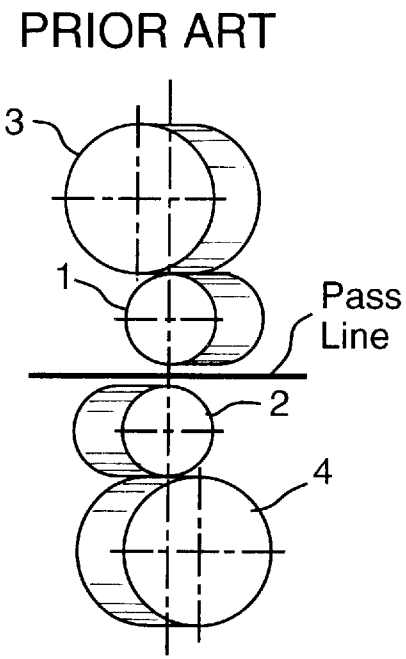
FIG. 3 is a schematic end elevation of a prior art pair-crossed mill in which both the work rolls and the backup rolls are crossed.
Figure 5:
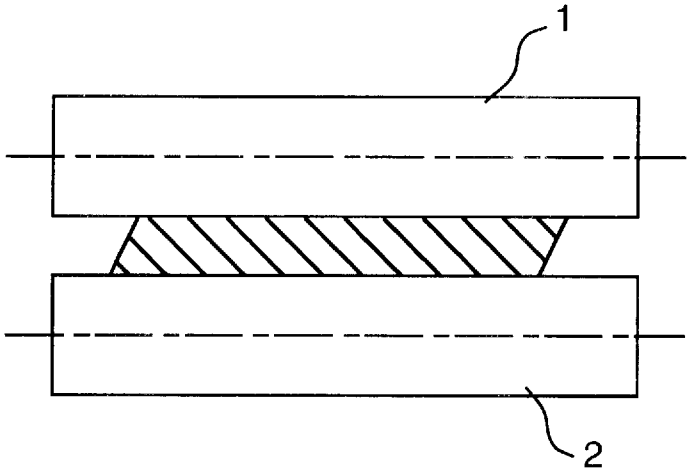
FIG. 5 is a schematic side elevation of a pair of crossed work rolls with a rolled workpiece therebetween illustrating the generally rhombic shape produced by such roll configuration.
Figure 4B:
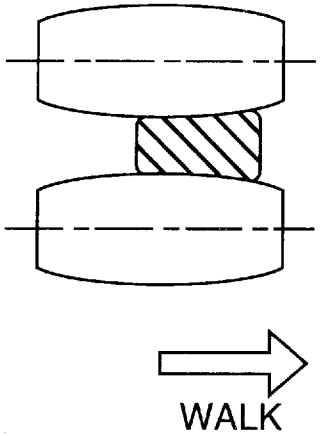
FIG. 4B is a schematic side elevation of a pair of crossed convex-shaped work rolls illustrating strip walking with this roll configuration.
Figure 4A:
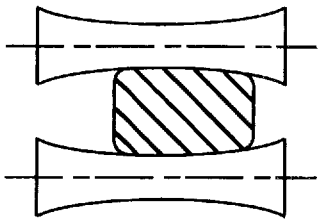
FIG. 4A is a schematic side elevation of a pair of crossed concave-shaped work rolls illustrating strip walking with this roll configuration.

FIGS. 1–3 illustrate, respectively, prior art work roll crossing, backup roll crossing and combined work roll and backup roll crossing (as used in a pair-cross mill). In these Figs. the numeral 1 denotes an upper work roll and the numeral 2 denotes a lower work roll. In each case, there is provided an upper backup roll 3 and a lower backup roll 4. The disadvantages of work roll crossing have been outlined above, such as "strip walking" as illustrated in FIGS. 4A and 4B, and production of a rhombic workpiece section as illustrated in FIG. 5. The high cost of backup roll crossing results from a complexity of the mechanism that is required to more very large backup rolls and their chocks in respect to the roll force hydraulic cylinders that produce the force on the backup roll chocks as great as six million pounds per side. In moving the chocks it is easy to misalign them with respect to the cylinders despite the use of special roller thrust bearings.

The crossed intermediate rolls of the invention are much smaller than the usual backup rolls and the roll chocks are not involved in alignment. Instead, the rolls float up and down, and a much smaller thrust force, e.g. about 4–5000 pounds is needed.

Figure 6:
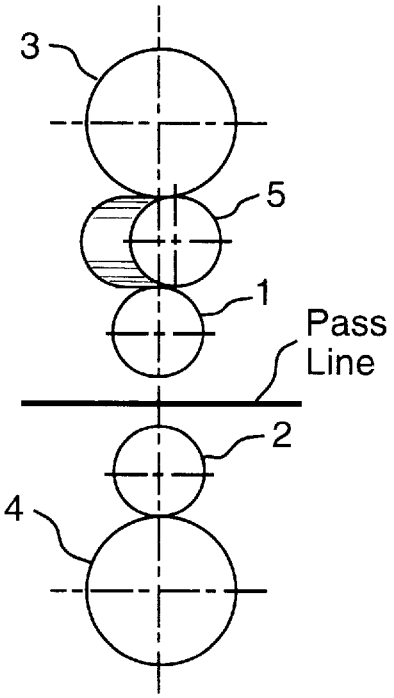
FIG. 6 is schematic end elevation of the rolls of a 5-high rolling mill having a single crossed intermediate roll in accordance with one aspect of the present invention.

FIG. 6 illustrates a 5-high mill according to the invention in which a single intermediate roll 5 is disposed, e.g. between the upper work roll 1 and the upper backup roll 3, and is designed for roll crossing.

Figure 7:
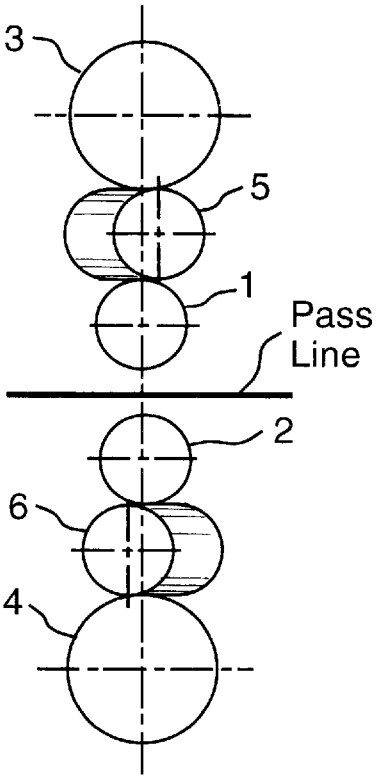
FIG. 7 is a schematic end elevation of the rolls of a 6-high rolling mill having two crossed intermediate rolls in accordance with another aspect of this invention.

FIG. 7 illustrates a 6-high mill according to the invention in which, in addition to having crossed intermediate roll 5, a second crossed intermediate roll 6 is provided, e.g. between the lower work roll 2 and the lower backup roll 4.

The crossed intermediate roll or rolls of this invention eliminate or drastically reduce the disadvantages of work roll crossing and reduce the costs and roll misalignment problems associated with expensive backup roll crossing. In most instances, the less roll crossing that is applied, the better the result—consistent with achievement of the needed strip flatness and profile control. Thus the lesser the crossing angle, the lesser the thrust force which is needed, reducing heavy equipment cost and enhancing performance. The two crossed intermediate rolls 5 and 6 of FIG. 7 are especially desired in this respect since a smaller crossing angle can be used with the two crossed intermediate roll design than with the single crossed intermediate roll design.

Crossing of the intermediate rolls of this invention can be implemented, for example, by utilizing the mechanisms as disclosed in U.S. Pat. No. 5,655,398.

What is claimed is:

1. In a rolling mill for rolling metal strip, said mill being of the type having upper and lower work rolls and a backup roll associated with each work roll, the improvement which comprises at least one intermediate roll disposed between a work roll and a backup roll, and means to cross said at least one intermediate roll at an angle to the work rolls and the backup rolls.

2. The mill improvement according to claim 1, wherein the mill comprises a first crossable intermediate roll disposed between an upper work roll and an upper backup roll and a second crossable intermediate roll disposed between a lower work roll and a lower backup roll.

3. A mill according to claim 1, which comprises a first crossable intermediate roll disposed between and upper work roll and an upper backup roll and a second crossable intermediate roll disposed between a lower work roll and a lower backup roll, and means to cross the first and second intermediate rolls.

4. A mill according to claim 2, which comprises a first crossable intermediate roll disposed between and upper work roll and an upper backup roll and a second crossable intermediate roll disposed between a lower work roll and a lower backup roll, and means to cross the first and second intermediate rolls.

5. A method of rolling a metal strip in a rolling mill having upper and lower work rolls and backup rolls, comprising providing at least one intermediate roll between at least one work roll and an associated backup roll, providing means to cross the least one intermediate roll, crossing the at least one intermediate roll, and cross rolling the strip thereby to reduce strip walking as compared to a mill using work roll crossing and to reduce cost of the mill as compared to the cost of a mill using backup roll crossing.

6. A method according to claim 5, comprising disposing a first intermediate roll between the upper work roll and the upper backup roll and a second intermediate roll between the lower work roll and the lower backup roll, and crossing the first and second intermediate rolls.

7. A method according to claim 5, further comprising permitting each intermediate roll to freely float up and down, and applying a thrust force to each intermediate roll of not more than about 4000 to about 5000 pounds, thereby reducing strip walking and the production of a rhombic-shaped workpiece as compared to a mill using work roll crossing and to reduce cost of the mill as compared to the cost of a mill using backup roll crossing.

8. A method according to claim 5, further comprising permitting each intermediate roll to freely float up and down, and applying a thrust force to each intermediate roll of not more than about 4000 to about 5000 pounds, thereby reducing strip walking and the production of a rhombic-shaped workpiece as compared to a mill using work roll crossing and to reduce cost of the mill as compared to the cost of a mill using backup roll crossing.

* * * * *